US006536057B2

(12) United States Patent
Fennell et al.

(10) Patent No.: US 6,536,057 B2
(45) Date of Patent: Mar. 25, 2003

(54) BED-TOP CO-SLEEPER AND METHOD

(76) Inventors: Hugh M. Fennell, 207 S. Rife St., Dillon, MT (US) 59725; Cheri L. Fennell, 207 S. Rife St., Dillon, MT (US) 59725

( * ) Notice: Subject to any disclaimer, the term of this patent is extended or adjusted under 35 U.S.C. 154(b) by 0 days.

(21) Appl. No.: 09/929,567

(22) Filed: Aug. 13, 2001

(65) Prior Publication Data

US 2003/0028968 A1 Feb. 13, 2003

(51) Int. Cl.[7] ..... A47C 21/08; A47G 9/06

(52) U.S. Cl. ..... 5/632; 5/655; 5/425

(58) Field of Search ..... 5/655, 424, 425, 5/417, 420, 482, 485, 632, 630

(56) References Cited

U.S. PATENT DOCUMENTS

| | | | | | |
|---|---|---|---|---|---|
| 3,800,340 | A | * | 4/1974 | Valentine | 5/485 |
| 3,924,282 | A | * | 12/1975 | Bond | 5/632 |
| 4,607,402 | A | | 8/1986 | Pollard | 5/425 |
| 4,726,551 | A | * | 2/1988 | Randall et al. | 5/655 X |
| 4,754,509 | A | * | 7/1988 | Pollard | 5/425 |
| 4,779,930 | A | | 10/1988 | Rosen | 297/464 |
| 4,873,734 | A | * | 10/1989 | Pollard | 5/425 |
| 5,331,699 | A | * | 7/1994 | Patton et al. | 5/655 |
| 5,351,348 | A | * | 10/1994 | Beger | 5/420 |
| 5,359,739 | A | * | 11/1994 | Rains et al. | 5/632 X |
| 5,367,730 | A | | 11/1994 | Sher | 5/655 |
| 5,450,640 | A | * | 9/1995 | Patton et al. | 5/655 |
| 5,530,974 | A | * | 7/1996 | Rains et al. | 5/630 X |
| 5,551,108 | A | | 9/1996 | Butler | 5/655 |
| 5,815,863 | A | * | 10/1998 | Dolisi | 5/632 |
| 5,937,461 | A | * | 8/1999 | Dombrowski et al. | 5/655 |
| 6,067,679 | A | * | 5/2000 | Rice | 5/630 |
| 6,052,848 | A | | 8/2000 | Kelly | 5/632 |
| 6,097,294 | A | | 8/2000 | Hilton | 340/573.1 |
| 6,112,347 | A | | 9/2000 | Tharalson | 5/95 |
| 6,154,900 | A | * | 12/2000 | Shaw | 5/632 X |
| 6,381,787 | B1 | * | 5/2002 | Rogone et al. | 5/655 |
| 2002/0042954 | A1 | * | 4/2002 | Straub | 5/655 |

* cited by examiner

*Primary Examiner*—Robert G. Santos

(57) ABSTRACT

A bed top co-sleeping device designed to be a simple fabric absorbent pad (1) with a protective safety cushion/body pillow enclosure (2)on one side, containing a removeable body pillow (6). When the complete unit (body pillow is inside enclosure) is placed on top of the bed, the parent will be able to co-sleep comfortably next to the infant without worry of breast milk leaking to the sheets, diaper changing messes or, the child rolling off the bed. With the body pillow removed, the one-piece fabric pad and body pillow enclosure allows for easy cleaning.

3 Claims, 2 Drawing Sheets

BED-TOP CO-SLEEPER AND METHOD

BACKGROUND—FIELD OF INVENTION

This invention relates to co-sleeping devices, specifically to devices that would allow for close parent to infant contact on top of existing beds.

BACKGROUND—DESCRIPTION OF PRIOR ART

The concept of co-sleeping has been the standard of infant care for timeless generations. The invent and use of crib, and bassinet type devices has been a recent trend. Since that time great concern has developed for the safety of infants who sleep in a crib, or in a room separate from the parents. The occurrence of sudden infant death syndrome (SIDS) has increased the intensity for the need of safe sleeping. To increase safety in the cribs and bassinets inventors have devised barriers, blocks, and cushions, all intended to restrict movement and assist breathing. As in U.S. Pat No. 5,551,108 by Butler, U.S. Pat. No. 5,537,730 by Sher.

U.S. Pat. No. 3,708,808 was given to Irby for an infant restraining device. Another device uses propping and restraining devices and provides a warning mechanism intended to alert the adult to any infant movement, U.S. Pat. No. 6,097,294 by Hilton. The theory cited by Hilton suggested that SIDS occurred due to breathing restrictions. Newer theories suggest that although ease of breathing is important, night time movement and physical contact are equally if not of greater importance. These reference patents are related to the present invention through the interest of infant safety, and prevention of SIDS. These references clearly intend to restrict movement of the infant, and physical contact with the parent. The returning trend towards co-sleeping is represented by U.S. Pat. No. 6,112,347 given to Tharalson, et al. They devised a crib alteration that allows the infant to sleep in a crib that is attachable to the parent's bed. This system continues to provide a distance from the parent, combined with a bulky structure that connects to the bed.

OBJECTS AND ADVANTAGES

Bringing the infant and parent back together to encourage contact, movement, and bonding is the main intent of our invention. Several objects and advantages are:

(a) to provide the parent a device which allows for safe movement;
(b) to provide a unit to be used by both parent and child;
(c) to provide the parent a fabric absorbent pad to rest upon with the child that compensates for leaking breast milk and diaper changes;
(d) to provide a side cushion to prevent the accidental rolling off of the child;
(e) to provide a removable body pillow for expectant mothers;
(f) to provide a one-piece design for ease of cleaning;
(g) to provide a safe environment that encourages and makes night time breast feeding easy.

It is the object of the present invention to bring cultures not recognizing the benefits of co-sleeping closer to those that do. Cultures that have low SIDS occurrences have co-sleeping as their standard. It is also the object of the present invention to bring parents back to a time when co-sleeping was the standard choice.

SUMMARY

In accordance with the present invention, a method of supporting an infant and parent together comprised a bed-top co-sleeping device which comprises a one-piece fabric absorbent pad, connected to a bolster shaped safety cushion/body pillow enclosure. The unit has a removable body pillow inside the safety cushion/body pillow enclosure. When the bed-top co-sleeping unit has it's body pillow removed, the body pillow should be the only item in use. When the body pillow is inserted into the safety cushion/body pillow enclosure, the unit is intended to be used as a co-sleeping device.

DRAWINGS

Drawing Figures

REFERENCE NUMBERAL IN DRAWINGS

Figure 1A:
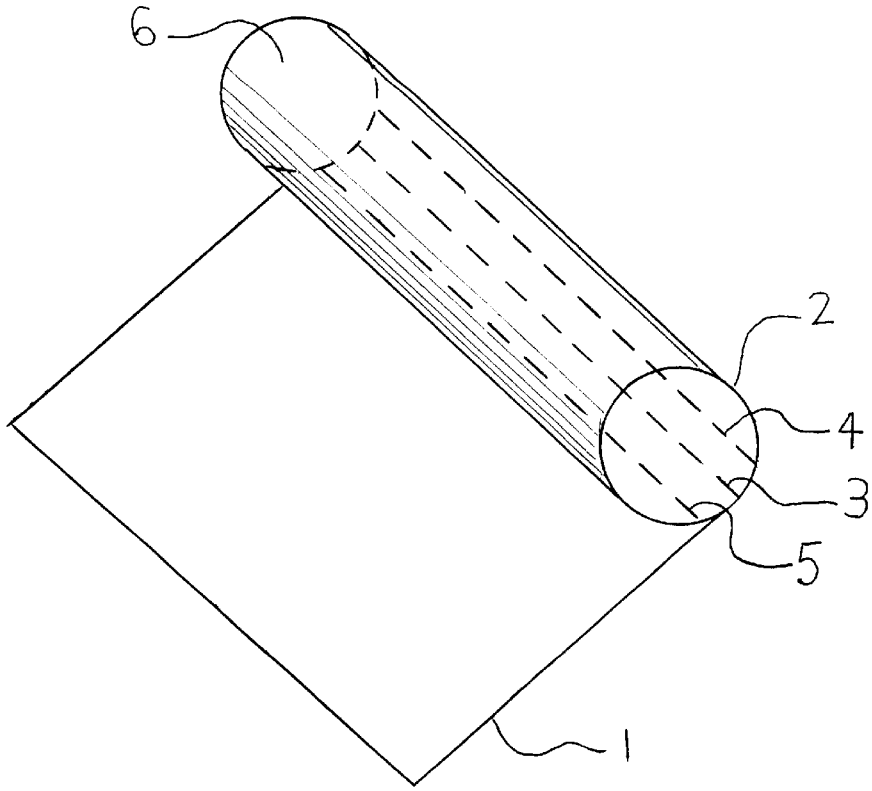
FIGS. 1A to 1B show the perspective top and bottom views of the bed-top co-sleeper utilized in the method of the current invention.

1 Absorbent pad
2 Safety cushion/Body pillow enclosure
3 Envelope seam for body pillow insertion/removal
4 Rear seam
5 Forward seam
6 Body Pillow

DETAILED DESCRIPTION

Figure 1B:
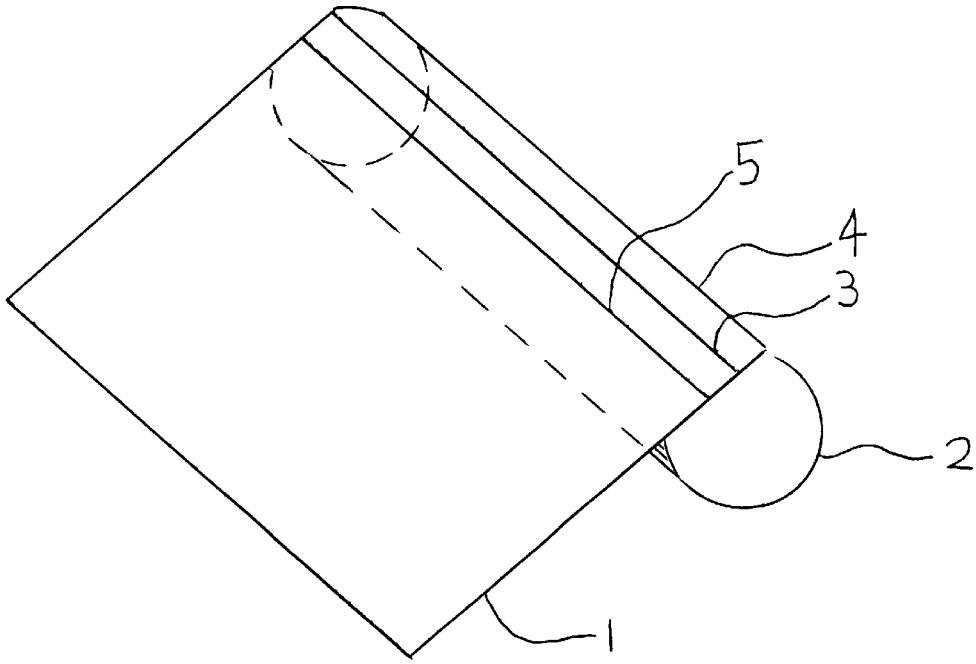
Figure 2:
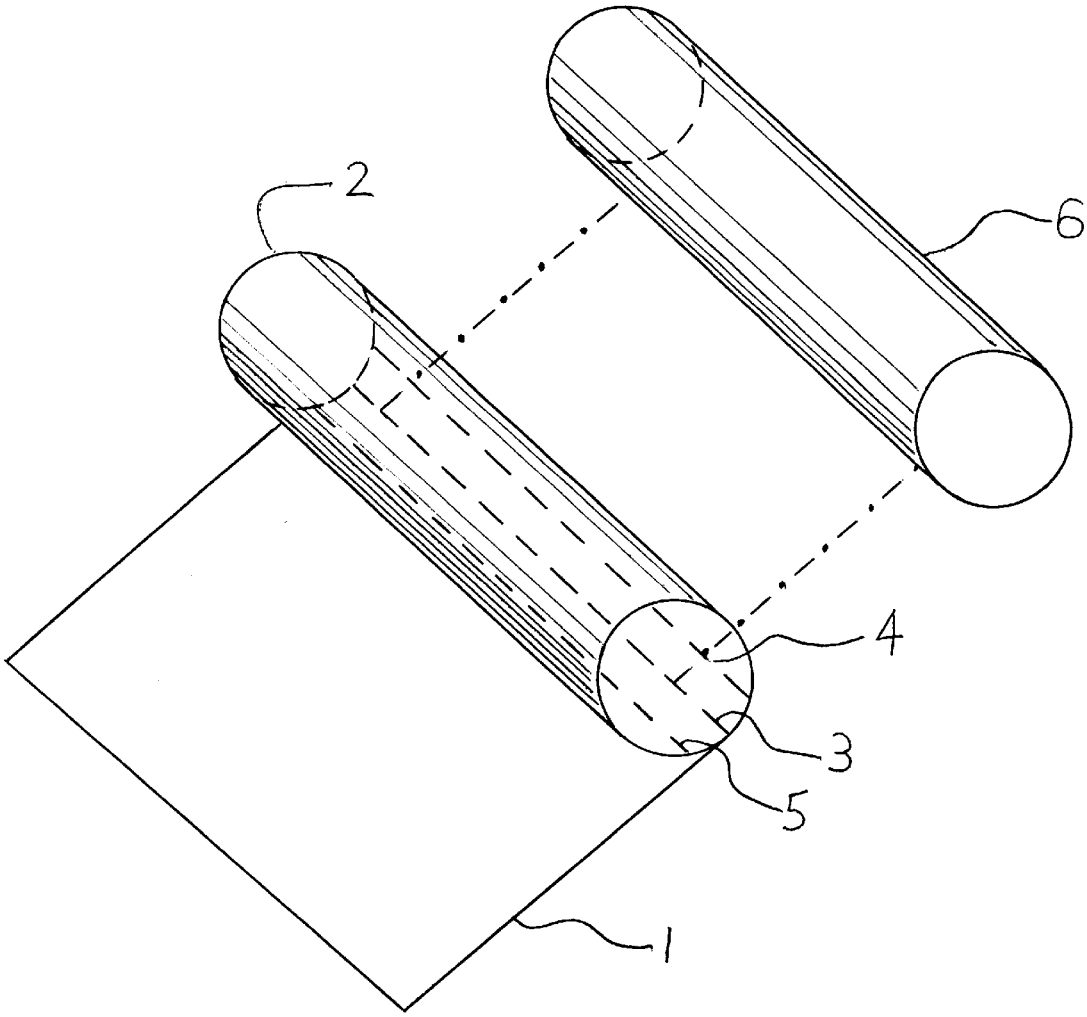
FIG. 2 shows the perspective top view of the bed-top co-sleeper with the body pillow removed.

Description—FIGS. 1A, 1B and 2—Preferred Embodiment

A preferred embodiment of the bed-top co-sleeper utilized in the method of the current invention is illustrated in FIG. 1A (top view) and FIG. 1B (bottom view). The unit has an absorbent pad 1 large enough to fit parent and child . The safety cushion/body pillow enclosure 2 is of a size large enough to not only decrease the likelihood of the child rolling off, but also provides a sizable body pillow 6 to aid the still pregnant mother. Forward and rear seams 4, 5 attach the safety cushion/body pillow enclosure 2 to the absorbent pad 1. The center envelope seam 3 provides for insertion and removal of the body pillow 6. The bed-top co-sleeper is made of a fabric that is completely washable when body pillow is removed.

FIG. 2 shows the body pillow 6 removed from the safety cushion/body pillow enclosure 2. The body pillow 6 is made of a semi-firm cushion designed to keep it's shape. It is permanently enclosed in a pillow case. When body pillow is removed, the bed-top co-sleeper is not intended to be used as a co-sleeping device. When the body pillow is inserted back into the safety cushion/body pillow enclosure the bed-top co-sleeper can safely be used as a co-sleeping device.

Conclusion, Ramifications, and Scope

Accordingly, the reader will see that when the bed-top co-sleeping device is used for co-sleeping with a child, it's intended use is for two people. When the bed-top co-sleeping unit has it's body pillow removed, the body pillow should be the only item in use. When the body pillow is inserted into the safety cushion/body pillow enclosure, the unit is intended to be used as a co-sleeping device. The advantages of this system are that

- it has pre-child delivery and post-child delivery uses;
- it has a body pillow to assist pregnant mothers with back pain, and sleeping problems;
- it provides a safe, cleanable, and conducive environment for parents that wish to co-sleep with their newborn child;

it provides a safe environment for, and encourages night time breast feeding.

This invention is intended to bring parents and their children closer together to emphasize bonding, safety, breast feeding, and ease of care for newborn difficulties.

We claim:

1. A method of supporting an infant and parent together, comprising the steps of:

a. utilizing a bed-top co-sleeping device comprising a fabric absorbent pad having a periphery and a plurality of sides, a safety cushion/body pillow enclosure attached to one of said sides of said fabric absorbent pad, and a removable body pillow inserted within said safety cushion/body pillow enclosure;

b. positioning said device on a support surface and underneath said adult such that said adult is disposed on one of said sides of said fabric absorbent pad located opposite from said safety cushion/body pillow enclosure and such that said adult is substantially disposed within said periphery of said fabric absorbent pad;

c. placing said infant on said fabric absorbent pad between said adult and said safety cushion/body pillow enclosure, such that the combination of said adult, safety cushion/body pillow enclosure, and removable body pillow offer the reduced chance of said infant rolling off said support surface or past said adult.

2. A method of supporting an infant and parent together, as recited in claim 1, wherein said removable body pillow is of a size which allows a pregnant adult to place said body pillow between said adult's knees and under said adult's head simultaneously when said body pillow is removed from said safety cushion/body pillow enclosure.

3. A method of supporting an infant and parent together, as recited in claim 1, further comprising the step of utilizing said device as a breast-feeding aid for said adult and said infant positioned together on said fabric absorbent pad, whereby said pad is capable of absorbing leaking or spilled breast milk.

* * * * *